US006476326B1

(12) United States Patent
Fuzier et al.

(10) Patent No.: US 6,476,326 B1
(45) Date of Patent: Nov. 5, 2002

(54) STRUCTURAL CABLE FOR CIVIL ENGINEERING WORKS, SHEATH SECTION FOR SUCH A CABLE AND METHOD FOR LAYING SAME

(75) Inventors: Jean-Philippe Fuzier, Orgeval; Jérôme Stubler, Paris, both of (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/744,930

(22) PCT Filed: May 29, 2000

(86) PCT No.: PCT/FR00/01462

§ 371 (c)(1),
(2), (4) Date: Jan. 31, 2001

(87) PCT Pub. No.: WO00/75418

PCT Pub. Date: Dec. 14, 2000

(30) Foreign Application Priority Data

Jun. 2, 1999 (FR) ..... 99 06967

(51) Int. Cl.[7] ..... H02G 3/04
(52) U.S. Cl. ..... 174/95; 174/113 R; 52/223.13
(58) Field of Search ..... 174/113 R, 95, 174/97; 138/115; 14/18, 22; 52/223.13, 223.14

(56) References Cited

U.S. PATENT DOCUMENTS

| | | | | | |
|---|---|---|---|---|---|
| 286,948 | A | * | 10/1883 | Martin | 174/95 |
| 764,779 | A | * | 7/1904 | Stone | 138/115 |
| 2,340,926 | A | * | 2/1944 | Bradley | 138/115 X |
| 3,941,157 | A | * | 3/1976 | Barnett | 138/115 |
| 4,197,695 | A | * | 4/1980 | Hughes et al. | 57/7 |
| 4,273,065 | A | * | 6/1981 | Lindsay et al. | 114/219 |
| 4,473,915 | A | * | 10/1984 | Finsterwalder | 14/18 |
| 5,036,891 | A | * | 8/1991 | Vogelsang | 138/115 |
| RE34,350 | E | * | 6/1993 | Dufossez | 52/223.13 |
| 6,079,134 | A | * | 6/2000 | Beshah | 174/95 X |

FOREIGN PATENT DOCUMENTS

| | | | |
|---|---|---|---|
| EP | 0220113 | * | 4/1987 |
| EP | 0855471 | * | 7/1998 |
| FR | 2660332 | * | 4/1990 |

* cited by examiner

*Primary Examiner*—Chau N. Nguyen
(74) *Attorney, Agent, or Firm*—Cantor Colburn LLP

(57) ABSTRACT

The structural cable has a bundle of substantially parallel tendons contained in at least one plastic protective sheath section. The plastic material of the sheath section extends between the tendons to form a coherent matrix for spacing the tendons. The cable may be used as a pre-stressing cable, a stay cable or a carrying cable for suspension bridges.

18 Claims, 1 Drawing Sheet

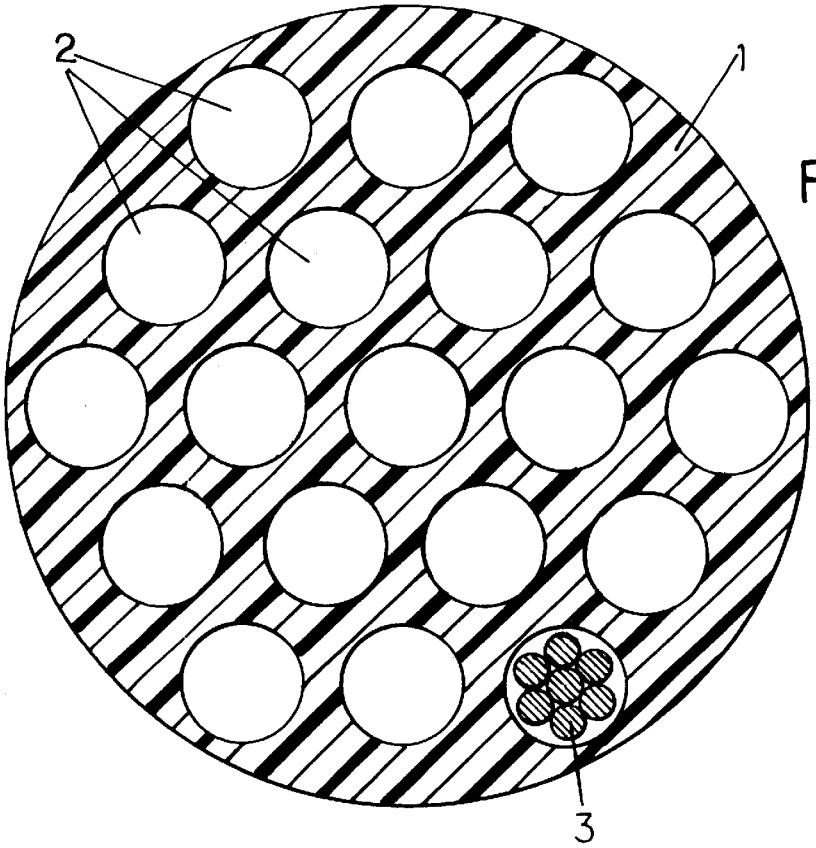
FIG.1.
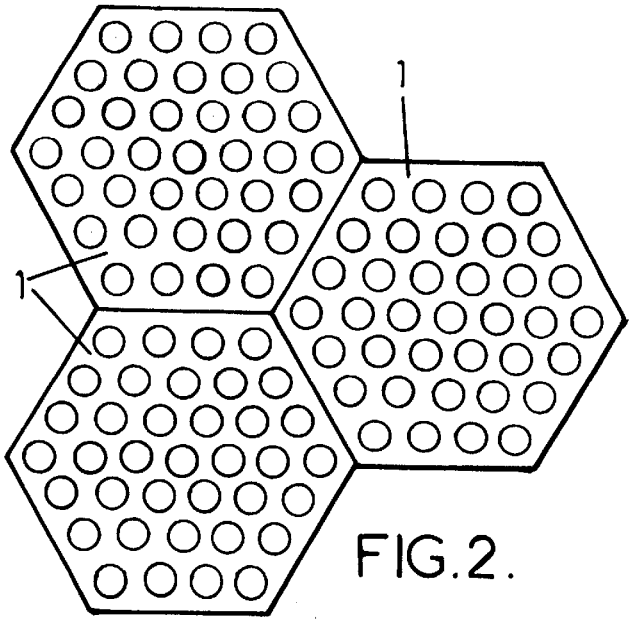
FIG.2.
FIG.3.
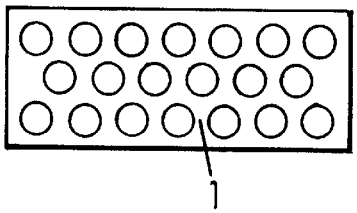
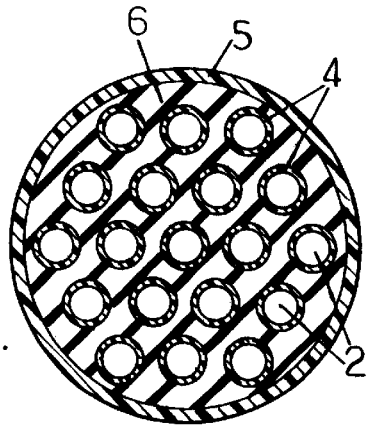
FIG.4.

STRUCTURAL CABLE FOR CIVIL ENGINEERING WORKS, SHEATH SECTION FOR SUCH A CABLE AND METHOD FOR LAYING SAME

TECHNICAL FIELD OF THE INVENTION

The present invention concerns structural cables used in civil engineering works. It is useful in particular in the fields of pre-stressing cables, stay cables or suspension bridges.

DESCRIPTION OF THE RELATED ART

Modern structural cables are often made up of unitary tendons (wires or strands) arranged in substantially parallel bundles inside sheaths or exposed to the air. In view of the aggressivity of the external environment and the durability requirements, these cables generally have protective layers of anti-corrosion material: oil, galvanization, grease, wax, filling with elastomer materials or cement grout, or external metal or plastic sheathing.

These anti-corrosion protections are applied on structural cables (pre-stressing cables, bridge stay cables, suspension cables or any other structural cables) either to the unitary tendons or to sub-assemblies of tendons, or globally to the whole cable.

The protections applied to unitary tendons have several advantages in isolating the unitary tendons of the cables electrically and mechanically. This isolation prevents electrical bridging, generalized corrosion of one section of the cable by "gangrene effect", and lateral contact between zones of curvature where pressure between tendons can produce stress concentrations detrimental to good static and dynamic behavior. It also prevents lateral contact in rectilinear sections when the tendons are free to move.

Individual protection of the tendons can take the form of sheathing: sheathed greased strands in the pre-stressing application, self-protected strands in stay cable structures, or coherent strands (EP-A-0 855 471).

In some applications the individually sheathed strands are positioned with their sheaths inside a mass of injected and hardened material, such as cement grout, which forms a mechanical spacer (see EP-A-0 220 113, EP-A-0 437 143, EP-A-0 465 303). When the strands are being put under tension the previously hardened mass maintains their transverse distribution in the sheath and prevents their deterioration in the curved sections of the cable.

SUMMARY OF THE INVENTION

An object of the present invention is to propose a method of protecting the tendons making up a structural cable which is compatible with diverse applications and diverse types of strand.

The invention thus proposes a structural cable for civil engineering works comprising at least one bundle of substantially parallel tendons contained in at least one plastic protective sheath section, wherein the plastic material of the sheath section extends between the tendons to form a coherent matrix for spacing the tendons.

The plastic protective sheath thus acts as a mechanical spacer for the strands and forms an individual sleeve for each strand.

A further advantage is to enable operations to inject material into the sheath after installation of the tendons to be dispensed with if appropriate. These operations are generally costly and difficult.

In particular embodiments of the structural cable according to the invention:

- the sheath section is a piece of plastic material having substantially parallel longitudinal bores which preferably do not inter-communicate; it is possible that one or more of these longitudinal bores does not contain a stretched strand but is provided to fulfill other functions (such as conduits for measuring sensors or optical communications fibers, etc.);
- the tendons are bare or individually protected metal strands;
- the cable comprises a plurality of successive sheath sections assembled mechanically or by welding;
- the sheath section has a circular or polygonal external cross section, for example, a shape allowing several bundles of tendons to be juxtaposed in a cable of relatively large cross section;
- the plastic material of the sheath section comprises a combination of materials; such a combination can include a material providing surface strength towards the outside of the sheath section, and a visco-elastic material and/or a material providing a low coefficient of friction with the tendons towards the interior of the sheath section;
- the sheath section, or an assembly of sheath sections assembled end to end, extends over substantially the entire length of a running section of the cable between, two end anchorages;
- the cable forms a pre-stressing cable, a stay cable or a carrying cable for suspension bridges.

A further aspect of the present invention relates to a structural cable sheath section for civil engineering works which constitutes a semi-finished product before insertion of the tendons. This sheath section forms a coherent spacing matrix having substantially parallel longitudinal bores suitable for receiving a cable tendon in each bore.

The matrix may be made of plastic material. It can also include a section made of injected material such as cement grout. In the latter case it can comprise, for example, individual plastic tubes for receiving the tendons arranged inside an external tube, the injected material filling the external tube around the individual tubes.

Yet another aspect relates to a method of laying a structural cable in civil engineering works, wherein a sheath having at least one sheath section forming a coherent spacing matrix with substantially parallel longitudinal bores is used, tendons are respectively inserted in at least some of the bores of the sheath section, and the tendons are tensioned.

The tendons may be inserted in the bores of the sheath section by traction on guides previously passed through the bores, or by pushing. They may be tensioned individually or collectively. Each tendon can be extracted and/or replaced separately in case of need.

BRIEF DESCRIPTION OF THE DRAWINGS

Other features and advantages of the present invention will appear in the following description of non-limiting embodiments with reference to the attached drawings, in which:

FIG. 1 is a cross-sectional view of a structural cable constructed according to the invention;

FIGS. 2 to 4 are cross-sectional views of variants of sheath sections according to the invention.

DETAILED DESCRIPTION OF THE PREFERRED EMBODIMENT

FIG. 1 shows a sheath section 1 formed by a plastic part of generally cylindrical form perforated by parallel longitudinal bores 2.

Each bore 2, which has a circular cross section, receives a metal tendon 3 of the cable. The example shown in FIG. 1 is a cable composed of 19 non-contiguous parallel tendons arranged in a hexagonal formation, only one of which is illustrated.

The sheath section 1 has a cylindrical external shape in the example of FIG. 1. This form could also be profiled to optimize its aerodynamic qualities. If the structural cable is exposed on the outside of the works, this external form can be provided in a known manner with elements or reliefs, for example, helicoidal in form, which reduce the risk of deformation by rain and wind.

The sheath is formed of a single section extending the full length of the cable between its two anchored ends, or of several successive sections assembled mechanically, for example by means of straps or sleeves, or welded end to end. In the latter case indexing marks may be provided for positioning the sections before assembly.

The plastic material of sheath section 1 can be a polyolefin such as a high-density polyethylene (HDPE). It can also have a resin base (for example epoxy). Sheath section 1 is manufactured, for example, by extrusion. Each section can be installed on a road transport or maritime freight semi-trailer to take it to the civil engineering construction site. It can also be rolled onto reels, allowing long sections to be transported to the construction site.

The plastic material of sheath section 1 can also be composite, and manufactured, for example, by co-extrusion. In such a case, the periphery of the sheath is made of a material selected for its surface resistance properties (resistance to shocks, climatic conditions, soiling, moistening), whereas the interior of the sheath is of material chosen for its visco-elastic properties (it then contributes to damping vibrations of the individual strands), and/or for its low coefficient of friction with the strands, facilitating their installation.

The insertion of each tendon 3 into a longitudinal bore 2 of the sheath 1 is facilitated because the tendon is guided into the bore, the diameter of which corresponds substantially to that of the tendon, being slightly greater. Two methods of inserting the tendons 3 can be adopted:

- after having previously passed a guide filament through each of the bores 2, connecting one end of the guide to one end of the tendon 3 and inserting the tendon 3 by traction on the guide;
- pushing the strand 3 from one end of bore 2 to the other by means of a mechanical roller thruster device.

The sheath formed by section 1 or several sections of this type placed end to end preferably extends the full length of the running portion of the cable between the two end anchorages.

An appreciable advantage of the invention is that each individual tendon of the cable can be withdrawn and replaced by means of a relatively simple device, similar to that used for the initial insertion, facilitating inspection and maintenance operations.

The tendons 3 of the cable can be metal wires or bare steel strands, as shown. In this case, a filler product such as a petroleum wax or a synthetic grease can be injected into the interstices between the sheath 1 and the tendons 3, protecting the steel against corrosion. This product can be the same as that injected into the anchoring arrangements at the ends of the strands, ensuring the uniformity and continuity of the anti-corrosion protection.

The tendons 3 can also be individually protected strands, which can then be simply inserted into the sheath. The protection can be an epoxy resin covering the wires making up the strand, a plastic envelope adhering to the steel of the wires, or a plastic envelope which does not adhere to the steel associated with a flexible product which protects the steel from corrosion and lubricates the steel-steel and steel-plastic contact zones. In the vicinity of the strand anchoring devices a sealing system of the stuffing box type, as described in patent application EP-A-0 323 285 can be provided, and the ends of the strands beyond the sealing system can be unsheathed in order to anchor them securely to the structure.

It is advantageous that there be no communication between the adjacent cylindrical conduits defined by longitudinal bores 2. Thus, if one of the strands 3 becomes affected by corrosion it does not tend to contaminate neighboring strands. This also guarantees lack of contact between adjacent strands, preventing them from clashing in case of vibration of the cable, and from deteriorating if they tend to press on each other under the effect of traction.

The transverse arrangement of holes 2 provided to receive the strands is advantageously regular, to limit the transverse spatial requirement of the cable. However, it could also be irregular.

The external profile of the sheath is not necessarily circular. Thus, FIGS. 2 and 3 show, in a non-limiting manner, sheath sections 1 with a polygonal external profile. The hexagonal form in FIG. 2 allows the realization of bundles, each comprising a sheathed assembly of strands, which can be easily assembled in parallel to form cables of relatively large cross section. The rectangular form in FIG. 3 is suitable for certain pre-stressing applications where strip-shaped cables are required.

In the example shown in FIG. 4 the sheath section in which the metal tendons are to be inserted is produced by arranging a collection of individual tubes 4 in an external tube 5, and by injecting a hardenable material 6 into the spaces remaining in the external tube 5 around the individual tubes 4. The interiors of tubes 5 then form the longitudinal bores 2 of the matrix formed by the sheath section. The injection and hardening of the material can take place at the factory or at the construction site. After hardening, the strands are inserted (before or after installing the sheath in its assigned position in the work), anchored, then put under tension.

Tubes 4 and 5 are made, for example, of HDPE, and the injected material 6 may be a plastic resin preferably having visco-elastic properties after hardening. Alternatively, the injected material 6 may be a cement grout.

One or more bores 2 provided in the sheath may not contain a strand, but serve as vent ducts or channels for receiving members such as optical fibers or sensors. The sheath then incorporates functions usually performed by separate means.

What is claimed is:

1. Structural cable for civil engineering works comprising at least one bundle of substantially parallel tendons contained in at least one plastic sheath section, wherein the sheath section is a prefabricated product and the plastic material of the sheath section extends between the tendons to form a coherent matrix for spacing the tendons.

2. Structural cable according to claim 1, wherein the sheath section is a plastic part having substantially parallel longitudinal bores.

3. Structural cable according to claim 2, wherein the longitudinal bores do not inter communicate.

4. Structural cable according to claim 2, wherein at least one of the longitudinal bores does not contain a tendon.

5. Structural cable according to claim 1, wherein the tendons are bare or individually protected metal strands.

6. Structural cable according to claim 1, wherein the at least one plastic protective sheath section comprises a plurality of successive sheath sections assembled mechanically or by welding.

7. Structural cable according to claim 1, wherein the at least one sheath section has a circular external cross section.

8. Structural cable according to claim 1, wherein the plastic material of the at least one sheath section comprises a combination of materials.

9. Structural cable according to claim 8, wherein the combination of materials includes a material providing surface resistance towards an outside of the sheath section, and a visco-elastic material towards an interior of the sheath section.

10. Structural cable according to claim 8, wherein the combination of materials includes a material providing surface resistance towards the outside of the sheath section, and a material providing a low coefficient of friction with the tendons towards the interior of the sheath section.

11. Structural cable according to claim 1, wherein the sheath section extends over substantially the full length of a running portion of the cable between two end anchorages.

12. Structural cable according to claim 1, wherein the structural cable is used as one of a pre-stressing cable, a stay cable, and a carrying cable for suspension bridges.

13. Structural cable according to claim 1, wherein the at least one sheath section has a polygonal external cross section.

14. Method for laying a structural cable in civil engineering works, comprising:

providing a sheath having at least one section forming a coherent spacing matrix and having substantially parallel longitudinal bores;

inserting respective tendons into at least some of the bores of the sheath section; and tensioning the tendons.

15. Method according to claim 14, wherein the inserting comprises attaching the tendons to respective guides previously passed through the bores, and pulling the guides to introduce the tendons into the bores.

16. Method according to claim 14, wherein the inserting comprises pushing the tendons into the bores.

17. Structural cable for civil engineering works comprising:

at least one bundle of substantially parallel tendons, at least one plastic protective sheath section containing the tendons;

means for anchoring the tendons in a tensioned condition, wherein the sheath section is a prefabricated product and the plastic material of the sheath section extends between the tendons to form a coherent matrix for spacing the tendons.

18. Method for laying a structural cable in civil engineering works, comprising:

providing a sheath having at least one section forming a coherent spacing matrix and having substantially parallel longitudinal bores;

inserting respective tendons into at least some of the bores of the sheath section; and tensioning the tendons; and anchoring the tensioned tendons.

* * * * *